United States Patent [19]

Stephany

[11] Patent Number: 4,949,950

[45] Date of Patent: Aug. 21, 1990

[54] ELECTROSTATIC SHEET TRANSPORT

[75] Inventor: Joseph F. Stephany, Williamson, N.Y.

[73] Assignee: Xerox Corporation, Stamford, Conn.

[21] Appl. No.: 310,103

[22] Filed: Feb. 14, 1989

[51] Int. Cl.[5] ..... B65H 29/00

[52] U.S. Cl. ..... 271/193; 271/18.1; 271/901; 198/619

[58] Field of Search ..... 271/18.1, 193, 264, 271/278, 901; 198/619; 355/308, 309, 321

[56] References Cited

U.S. PATENT DOCUMENTS

| | | | |
|---|---|---|---|
| 3,017,982 | 1/1962 | Sittel | 198/1 |
| 3,404,418 | 10/1968 | Fantuzzo | 15/1.5 |
| 3,675,757 | 7/1972 | Yabuta | 198/619 |
| 3,697,170 | 10/1972 | Bhagat et al. | 355/17 |
| 3,708,248 | 1/1973 | Haldeman, III | 417/48 |
| 3,754,830 | 8/1973 | Phillips et al. | 356/103 |
| 3,778,678 | 12/1973 | Masuda | 317/3 |
| 3,815,000 | 6/1974 | Phillips et al. | 317/262 |
| 3,832,053 | 8/1974 | Goel et al. | 355/3 R |
| 3,872,361 | 3/1975 | Masuda | 317/262 |
| 3,927,877 | 12/1975 | Terajima | 271/11 |
| 3,966,199 | 6/1976 | Silverberg | 271/275 |
| 3,981,498 | 7/1976 | Fletcher | 271/193 |
| 3,991,995 | 11/1976 | Sue | 271/64 |
| 4,389,165 | 6/1983 | Ono et al. | 417/49 |
| 4,700,262 | 10/1987 | Inculet | 361/233 |

FOREIGN PATENT DOCUMENTS

| | | | |
|---|---|---|---|
| 390847 | 12/1973 | U.S.S.R. | 198/619 |
| 390848 | 12/1973 | U.S.S.R. | 198/619 |
| 394272 | 1/1974 | U.S.S.R. | 198/619 |
| 630180 | 9/1978 | U.S.S.R. . | |
| 776977 | 11/1980 | U.S.S.R. . | |
| 825428 | 4/1981 | U.S.S.R. . | |
| 981164 | 12/1982 | U.S.S.R. . | |

*Primary Examiner*—H. Grant Skaggs
*Assistant Examiner*—Boris Milef

[57] ABSTRACT

A system and method of transporting a sheet along a sheet path with electrostatic forces by applying corona charges to the sheet in pulses from high voltage corona generating electrodes in plural arrays extending along at least one side of the sheet path and subjecting the charged sheet to an electrical field pattern, defined by unevenly opposing electrodes spaced on the opposite side of the sheet path to provide an electrostatic force component acting on the charged sheet to move the sheet along the sheet path. The unevenly opposing electrodes may include grounded electrodes adjacent the downstream end of each array and commonly biased electrodes adjacent the upstream end of each array. Three different embodiments are illustrated.

5 Claims, 2 Drawing Sheets

ELECTROSTATIC SHEET TRANSPORT

Figure 1:
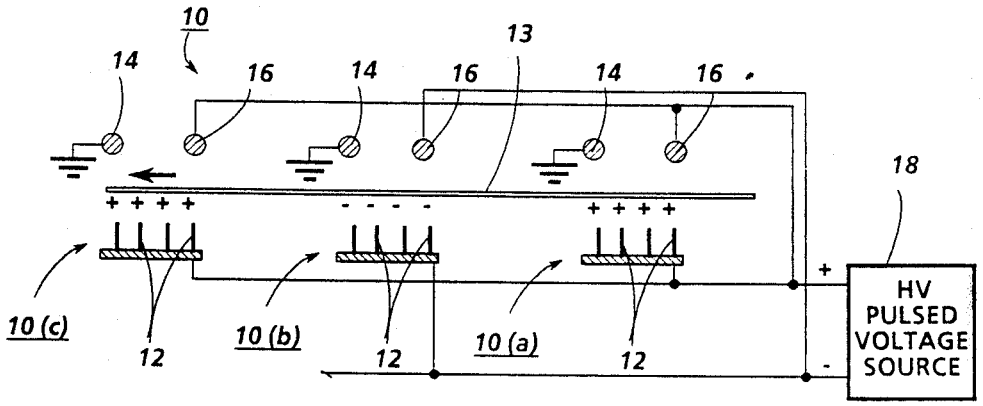

The present invention relates to an electronic sheet transport system, in which sheets may be electrostatically transported without requiring any mechanical sheet movement means or movement of any electrodes. The sheet may be moved by electrostatic forces by placing ions on the sheet and shaping and changing the electrical fields acting thereon. This sheet transport system may be used for various sheet feeding or transporting paths in electrostatographic copying or other printing systems. The disclosed sheet transport system may he utilized in any desired path or configuration.

The disclosed sheet transport system can move an ordinary filmsy copy paper sheet, or various other types of sheets, and in some configurations even thin metal foil sheets, by varying (switched or pulsed) high voltage electrode field patterns alone, from stationary high voltage electrodes along the sheet path. The sheet may ion charged tangentially from stationary electrodes and propelled electrostatically with a transverse force component in the desired direction of sheet movement. The appropriate non-tangential or horizontal field component may be defined by an array of corona generating pin or saw tooth discharge electrodes on one side of the sheet path and opposing electrodes on the other side of the sheet path. The sheet path elements themselves do not need to move, i.e., no moving belts and undesirable moving electrical contacts therewith are required, nor are any motors to drive any transports required. A purely electronic sheet transport system may be provided.

By selectively electrically actuating selected electrodes or areas of electrodes the sheet movement can be started and/or stopped with electrical signals at any desired position along the sheet path, or reversed, to provide a completely electronic path control. That positional movement control may be electronically integrated with electro-optic or other known sheet position detectors.

Furthermore, the sheet can actually be electrostatically levitated from the array or bed of electrodes, and moved while so leviatated, for very low friction and low wear movement. The vertical levitating or repelling force on the paper can be varied by changing the applied pulse width, and/or the interpulse voltage level. By pulsing or turning off periodically the applied field the sheet is prevented from being driven against the opposing electrodes on the other side of the sheet path.

Otherwise, conventional power supply circuitry may be used to power the electrodes. For example, circuitry such as is already available in many copiers and printers for other well known electrostatic functions such as photoreceptor surface corona charing or image transfer corona generator corotrons or scorotrons. Applying approximately 14 kilovolts to the electrodes is sufficient, and conventional high impedance low current, low power, circuitry may be used, providing operator protection. Conventional transistor chopper or other such well know circuity may be used to provide the desired low frequency pulsed output and interruptions.

While the present system, without electronic sensing of paper position, may not be sufficiently fast for high speed xerographic copiers or printers, it is suitable for relatively slower copiers of printers of various types, including ink jet, thermal imaging, and other non-xerographic printers, or other sheet handling operations.

With electronic paper position sensing and levitation of the paper so that it never touches any electrodes after acquiring a charge sufficient for motion, higher speeds are anticipated.

By way of background, as noted, for example, in U.S. Pat. No. 3,966,199 issued Jun. 29, 1976 to M. Silverberg, the accurate and reliable transport of copy sheets, particularly cut paper, through the various work stations of electrostatographic copying systems is a particular problem due to the highly variable nature of such materials. Paper jams are one of the main cuases of copying machine shut-downs. Various sheet transporting devices, such as mechanical grippers, vacuum and other transport belts, feed rollers, a charged photoreceptor, etc., are well known. Generally several different transport systems are utilized, and the sheets must he transferred between transport systems. Each such sheet transport and transfer adds a potential jam area, especially if the sheet has a preset curl.

By way of background, electrostatic sheet transports which electrostatically hold the paper to a belt and move the paper by movement of the belt are know in the xerographic patent literature, such as U.S. Pat. No. 3,981,498; 3,832,053; and art cited therein. It is thus generally known that a copy sheet can be transported on a moving belt or other member on which it is held by an electrostatic charge. The following further U.S. patents are cited in said U.S. Pat. No. 3,966,199 as exemplary of this art: U.S. Pat. Nos. 2,576,882 to P. Koole et al.; 3,357,325 to R. H. Eichorn; 3,642,362 to D. Mueller; 3,690,646 to J. A. Kolivis; 3,717,801 to M. Silverberg; and 3,765,957 to J. Weigl. Electrostatic original document detention is disclosed in U.S. Pat. Nos. 3,194,131; 3,419,264; and 3,634,740; of which 3,419,264 disclosdes a moving electrostatic document belt. (As noted, the system disclosed here does not do that. No moving belts or their drives are required with the present system.) Other references to belt copy sheet transport systems, specifically for transfer stations in xerographic copiers, with corona generator electrostatic sheet tacking include U.S. Pat. Nos. 3,404,418, issued Oct. 8, 1968, to J. Fantuzzo, and U.S. Pat. No. 3,697,170, issued Oct. 10, 1972, to G. C. Bhagat and J. M. Randall. Various of the references cited herein teach details of various suitable exemplary xerographic copier and other such structures, which need not be disclosed herein.

The general concept of using electric field forces to lift and move a sheet of paper along a path seems to be addressed in the following Soviet Union inventors certificates, although they are not entirely clear; USSR Nos. 630,180; 776,977; 825,428; and 981,164; of which inventors certificate 825,428 appeared to the searcher to be the most relevant, and a translation was obtained, which indicates that some of the electordes are rotating, i.e., must be driven.

By way of general background, as to using electric fields to move particulate material along a tube, are U.S. Pat. Nos. 3,778,678; 3,872,361; and 4,700,262. Of possible collateral interest are U.S. Pat. Nos. 3,017,982; 3,708,248; 3,754,830; 3,815,000; 3,927,877; 3,991,995; and 4,389,165.

A specific feature disclosed herein is to provide an electrostatic sheet tranpsort system for transporting a sheet downstream along a generally planar sheet path; comprising plural arrays of corona generating electrodes extending along at least one side of the lane of the sheet path, and unevenly opposing electrodes spaced on the opposite side of the plane of the sheet path, said corona generating electrodes arrays being pulsed with a pulsed high voltage, for pulsatingly applying corona charges to the sheet, to generate with said corona generating electrodes and said unevenly opposing electrodes an electrical field pattern with a force component acting on said charged sheet to move it along said generally planar sheet path.

Further features provided by the system disclosed herein, individually or in combination, include those wherein said pulsed high voltage applied to said corona generating electrodes is periodically interrupted or reversed in polarity at a low frequency rate, and/or wherein said unevenly opposing electrodes comprise grounded electrodes adjacent the downstream end of each said array and biased electrodes adjacent the upstream end of each said array.

Another specific feature disclosed herein is to provide a method of transporting a sheet along a generally planar sheet path utilizing electrostatic forces; comprising applying corona charges to the sheet in pulses from high voltage corona generating electrodes extending along at least one side of the of the plane of the sheet path and subjecting the charged sheet to an electrical field pattern defined with unevenly opposing and differently biased electrodes spaced on the opposite side of the plane of the sheet path, to provide an electrostatic force component acting on said charged sheet to move it along said sheet path; and/or wherein said charged sheet is levitated by said electrical field pattern and is moved along said generally planar sheet path soley by electrostatic forces from said electrical field pattern; and/or wherein said unevenly opposing electrodes are non-corona electrodes alternately grounded and voltage biased.

All references cited in this specification, and their references, are incorporated by reference herein where appropriate for approriate teachings of additional or alternative details, features, and/or technical background.

Figure 2A:
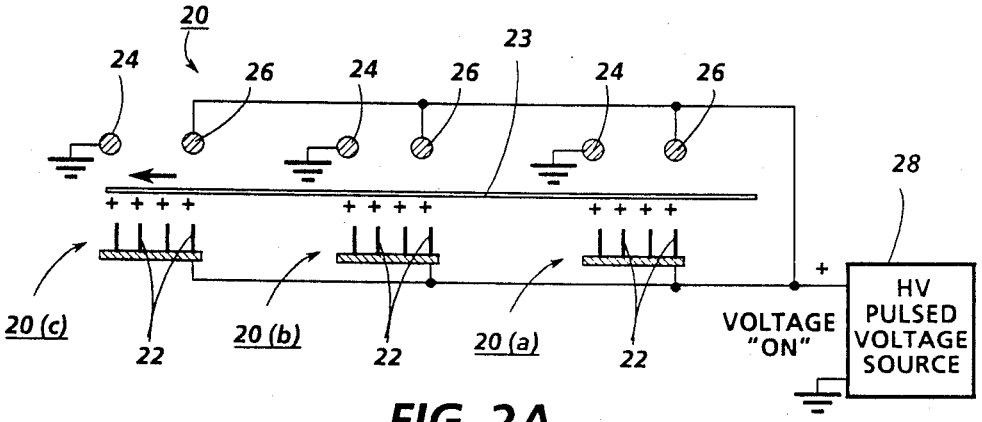
Figure 2B:
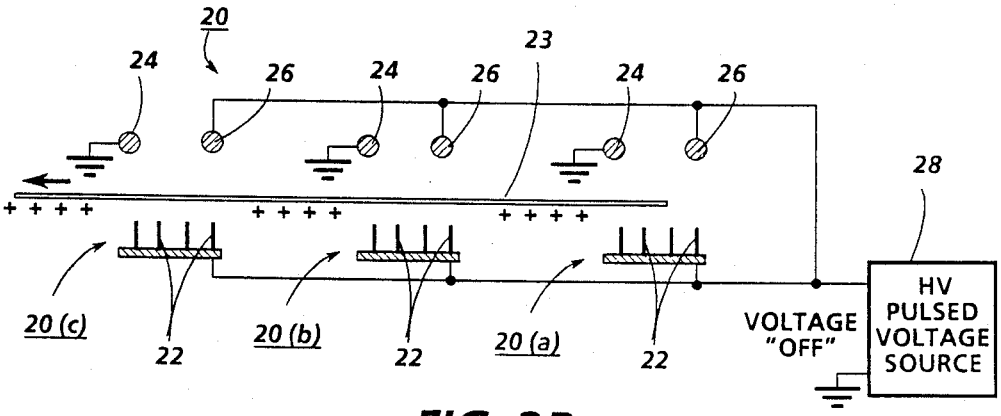
Figure 2C:
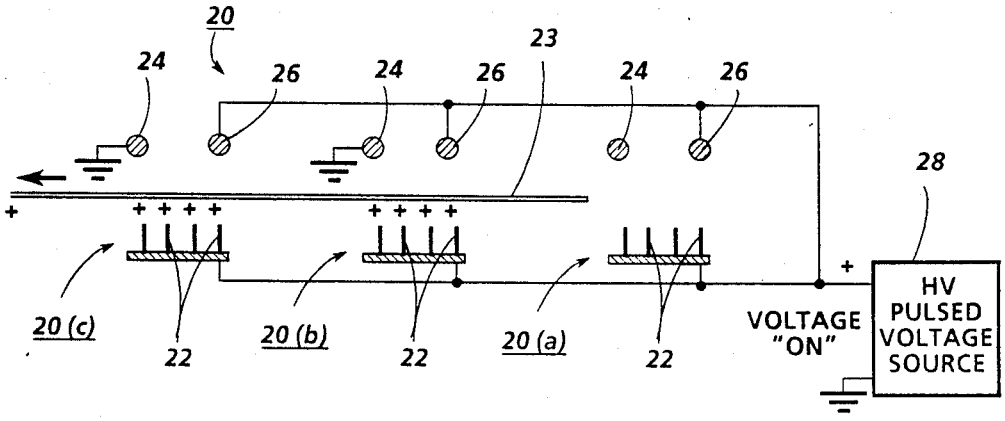
Figure 3:
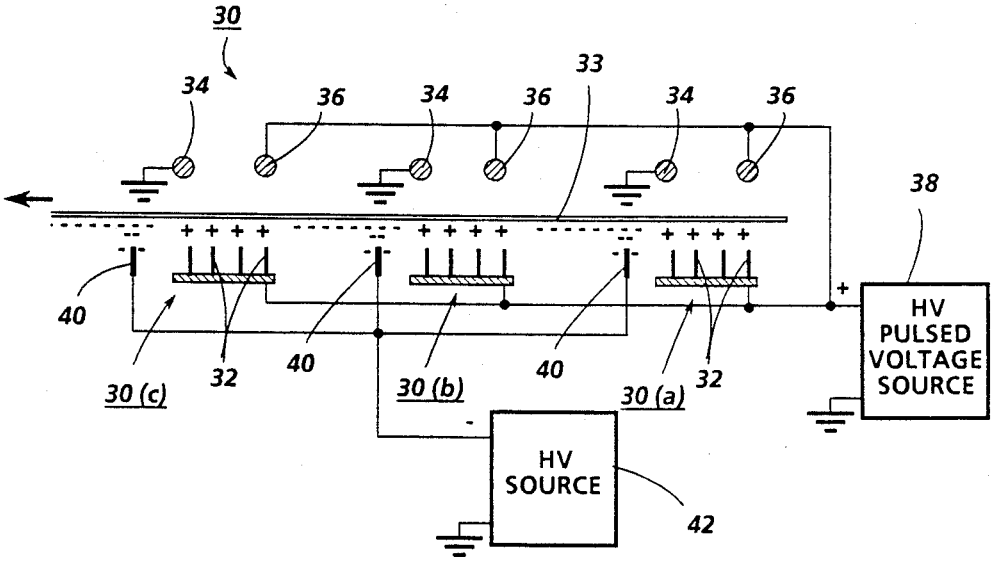

Various of the above-mentioned and further features and advantages will be apparent from the specific apparatus and its operation described in the examples below. The present invention will be better understood by reference to this description of these embodiments thereof, wherein:

FIGS. 1–3 sechematically illustrate side views of three different multistage electrostatic sheet transport system exemplary embodiments in accordance with the teachings of this invention.

Referring to the three different electrostatic sheet transport system exemplary embodiments 10, 20 and 30 of FIGS. 1–3, respectively, all of them schematically illustrate a portion of the sheet path of an electrostatic sheet transport system. In each, an appropriate non-tangential or horizontal field component for moving the sheet along the sheet path (to the left here) may be defined by respective arrays 10(*a*),(*b*),(*c*); 20(*a*),(*b*),(*c*); 30(*a*),(*b*),(*c*) of beds of corona generating pin discharge electrodes 12, 22, 32 on one side of the plane of the sheet path plus opposing but offset rod or plate electrodes on the other side of the plane of the sheet path. All of the electrodes may be pathtraversing, i.e., extend transversely across the sheet path. Each rod electrode 14, 24 or 34 is electrically grounded and is located adjacent the downstream end of the respective opposing set of pin electrodes 12, 22 or 32 in each array. Further (second) rod or plate electrodes 16, 26, 36 on the same other side of the sheet path may be commonly or equally biased with the respective opposing pin discharge electrodes by common electrical connections as shown. However, these biased rod electrodes 16, 26, 36 are located adjacent the upstream end of the respective opposing set of pin electrodes in each array. A path segment of only three such arrays or stages (a),(b),(c) are shown in each Figure here, but it will be appreciated that they may be repeated indefinitely along the sheet path depending on its desired length. The electrode configurations may also vary widely. The respective FIGS. 1–3 high voltage power supplies (pulsed voltage sources) 18, 28, 38 are all schematically illustrated with their respective circuitry connections to the electrodes. There is preferably an approximately 20 Hertz, for example, modulation of the voltage output (20 pulses per second output).

The differences between the three different embodiments of FIGS. 1–3 may be seen from the illustrated electrode voltage connections circuitry and illustrated polarities.

In the system 10 of FIG. 1, each set of pin electrodes, 12, places a charge on the sheet of paper 13, by operating the voltage from the power supply 18 above the point of ionization at the points of the pin electrodes 12, a value of about 14 Kilovolts for both the positive and negative output from this supply. This places a charge on the bottom side of the paper 13. The opposite or top side of the paper will have an induced charge of the same sign, created there by inherent dielectric charging of the paper. Because of this charge on the paper the paper will be repelled from the pin electrodes 12, and attracted to the grounded rod electrodes 14, which have an induced charged of opposite sign, as is well known to those skilled in the art. The paper 13 will therefore start to move towards the rod electrodes 14. This force acting on the paper 13 has a horizontal or tangential component and a vertical component. If the voltage were left on for an indefinitely long period, the paper would eventually stick to the rod electrodes 14. But before this can occur, the outputs of the high voltage supply 18 are reduced to zero. Since a charge exists on the paper, the paper is now attracted towards the pin electrodes 12 by an induced charge similar to that which caused attraction to the rod electrodes 14 when the voltage supply was on. This attraction creates a vertical downward force that aproximately cancels the vertical upward force that was generated when the high voltage power supply 18 was on. This results in only a net horizontal force moving the paper horizontally. The paper will thus hop or move a small increment in the horizontal direction. By repeating this operation at the rate of approximately 20 times per second, the paper 13 will steadily move to the left in the drawing here.

The additional chargeable rod electrode 16 is used to additionally shape the direction of the electric field between the charge on the paper 13 and the grounded rod electrode 14, to further increase the magnitude of the tangential or horizontal force component while decreasing the vertical force in the upward direction on the paper, since each rod electrode 16 is connected to the same voltage source as the pin electrodes 12.

In the FIG. 1 embodiment 10, the sequential, alternate, stages or arrays 10(*a*),(*b*),(*c*) of corona pin electrodes 12 are operated with oppositepolarity applied voltages. Each stage 10(*a*),(*b*),(*c*) alters the polarity of the charge on the sheet 13, by corona charging, so that the next stage will apply a charge that will cancel the charge created by the previous stage. If this were not done, there would be an attractive force that would tend to create a force that would then move the paper back in the horizontal direction, and cancel the net force created during each paper movement cycle. However, the charge reversal time required by reversing the charge on the paper between alternate sets of pin electrodes 12 may restrict the sheet transporting speed.

In the second system 20 of FIGS. 2A–2C, the corona pin electrode 22 arrays 20(*a*),(*b*),(*c*) are respectively connected to the same polarity high voltage source 28, and the operation is more like a linear accelerator. High voltage source 28 only puts out a single polarity voltage, but it is pulsed, and can additionally be controlled in amplitude as well as turned on and off at a rapid rate. A corona charge is placed on the paper sheet 23, as described above for sheet 13, and the paper 23 starts moving horizontally in a pulsed manner. Preferably the paper position is sensed by a suitable or conventional path position sensing system, and that that sensing arrangement can control the voltage of the power supply 28. Once the charge is placed on the paper, the voltage from the high voltage power supply may be reduced below the ionization point so that no further additional charging of the paper occurs. The output from the power supply 28 continues, however, at a magnitude sufficient to keep the paper levitated by operating this supply at an interruption frequency of about 20 times per second. A sensing mechanism, not shown, can be used to automatically adjust the amplitude of the power supply to maintain sheet levitation at a desired vertical position. As the positive charged section of the paper moves under the rod electrode 24, the voltage from the power supply is entirely reduced to a low value to prevent an appreciable force from accelerating the paper against the desired direction of motion, as illustrated in FIG. 2B. As the charged sections of the paper pass over the next stage or set of pin electrodes 22, the cycle is repeated to further induce a levitation and horizontal accelerating force in the paper.

In the third system 30 of FIG. 3 there are additional corona electrodes 40 positioned between stages and connected to a high voltage source 42 to provide ions of opposite sign or polarity to the sheet 33 between the stages 30(*a*),(*b*),(*c*). The high voltage source 42 may be either a negative voltage source or an alternating source of voltage generating both positive and negative ions to discharge the paper. The purpose of these additional electrode stages 40 is to remove charge place on the paper to prevent or reduce a horizontal force tending to oppose the desired direction of movement of the paper 33. It is also possible that such a reduction in charge could be accomplished by a source of ultraviolet light in lieu of electrodes 40.

While the embodiments disclosed herein are preferred, it will be appreciated from this teaching that various alternatives, modifications, variations or improvements therein may be made by those skilled in the art, which are intended to be encompassed by the following claims.

What is claimed is:

1. An electrostatic sheet transport system for transporting a sheet in a downstream direction along a generally planar sheet path; comprising plural arrays of corona generating electrodes extending along at least one side of the plane of the sheet path, and opposing electrodes spaced on the opposite side of the plane of the sheet path, said opposing electrodes and said arrays of corona generating electrodes being offset relative to one another in said downstream sheet path direction, said corona generating electrodes arrays being pulsed with a pulsed high voltage, for pulsatingly applying corona charges to the sheet, to generate with said corona generating electrodes and said offset opposing electrodes electrical field patterns with electrostatic force components acting on said charged sheet in said downstream sheet path direction to move it along said generally planar sheet path.

2. The electrostatic sheet transport system of claim 1, wherein said pulsed high voltage applied to said corona generating electrodes is periodically reversed in polarity at a low frequency rate.

3. The electrostatic sheet transport system of claim 1, wherein said opposing electrodes comprise grounded electrodes adjacent the downstream end of each said array of said corona generating electrodes and biased electrodes adjacent the upstream end of each said array of corona generating electrodes.

4. A method of transporting a sheet along a generally planar sheet path in a downstream direction utilizing electrostatic forces; comprising applying corona charges to the sheet in pulses from high voltage corona generating electrodes extending along at least one side of the of the plane of the sheet path and subjecting the charged sheet to an electrical field pattern defined with unevenly opposing and offset in said downstream sheet path direction and differently biased electrodes spaced on the opposite side of the plane of the sheet path, to provide an electrostatic force component acting on said charged sheet in said downstream sheet path direction to move it along said sheet path.

5. The method of transporting a sheet of claim 4 wherein said charged sheet is levitated by electrostatic forces produced by said electrical field pattern and is moved along said generally planar sheet path solely by electrostatic forces from said electrical field pattern, and wherein said unevenly opposing electrodes are non-corona electrodes alternately grounded and voltage biased.

* * * * *